United States Patent [19]

Gaubert

[11] 4,341,522

[45] Jul. 27, 1982

[54] METHOD AND APPARATUS FOR MAKING POUCHES WITH DISPENSING FITTINGS

[76] Inventor: Rene J. Gaubert, 4219 Oakmore Rd., Oakland, Calif. 94602

[21] Appl. No.: 146,506

[22] Filed: May 5, 1980

[51] Int. Cl.[3] ..... B31B 1/84

[52] U.S. Cl. ..... 493/213; 493/929; 493/932

[58] Field of Search ..... 493/213, 212, 215, 214, 493/929, 932

[56] References Cited

U.S. PATENT DOCUMENTS

| | | | |
|---|---|---|---|
| 3,011,293 | 12/1961 | Rado | 493/213 X |
| 3,283,671 | 11/1966 | Campbell, Jr. | 493/213 X |
| 3,783,080 | 1/1974 | Goglio | 493/213 X |
| 3,868,891 | 3/1975 | Parish | 493/213 X |
| 3,894,381 | 7/1975 | Christine et al. | 53/128 |
| 4,055,032 | 10/1977 | Hammond | 156/514 X |
| 4,120,134 | 10/1978 | Scholle | 53/434 |
| 4,246,062 | 1/1981 | Christine | 156/498 |

FOREIGN PATENT DOCUMENTS

| | | |
|---|---|---|
| 1021210 | 3/1966 | United Kingdom . |
| 1191701 | 5/1970 | United Kingdom . |

*Primary Examiner*—James F. Coan

*Attorney, Agent, or Firm*—Flehr, Hohbach, Test, Albritton & Herbert

[57] ABSTRACT

A machine and method for making pouches from plastic film material, with one or more fittings secured to a wall of the pouch. A web of the plastic film material is progressed through fitting depositing and fitting securing regions, after which pouches are made which incorporate the web portions to which the fittings are secured. All operations of the machine are automatic.

8 Claims, 18 Drawing Figures

FIG.-6
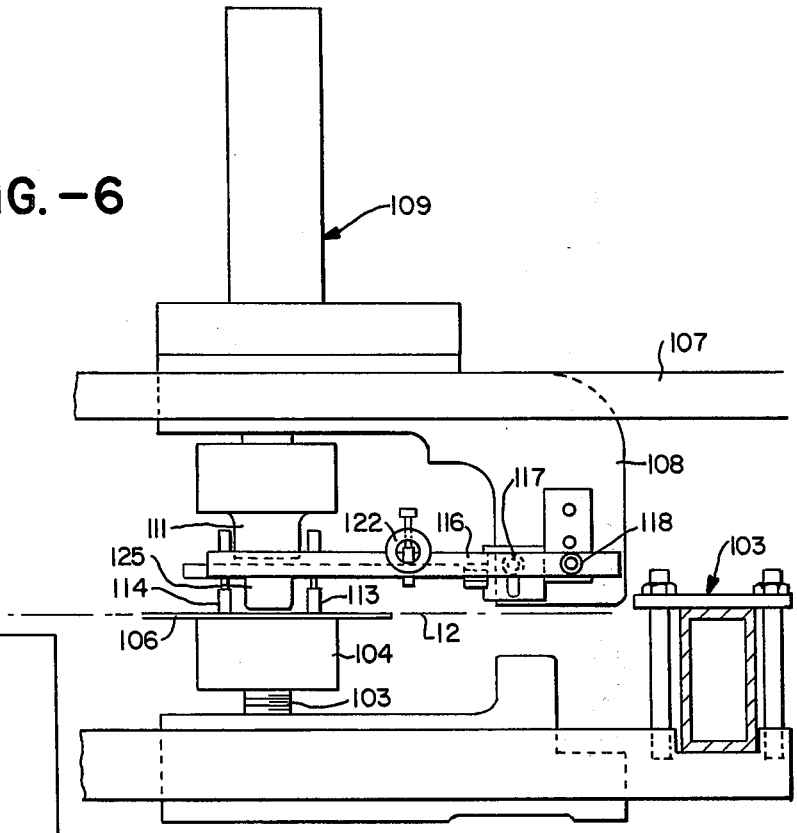
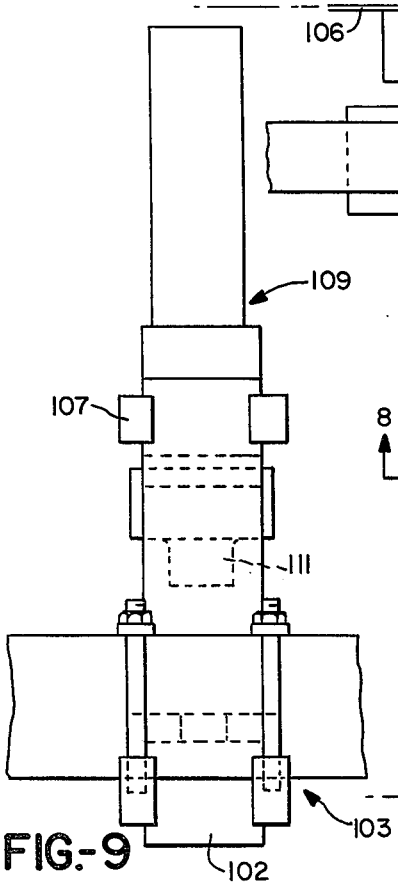
FIG.-9
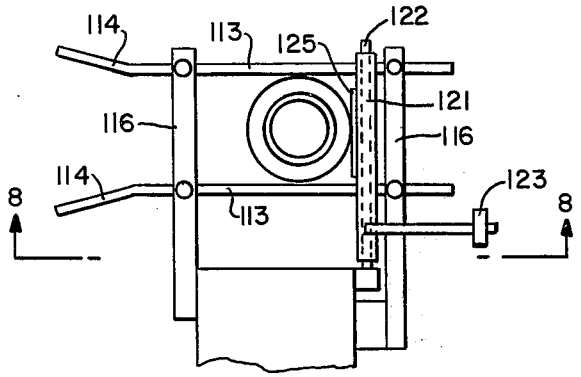
FIG.-7
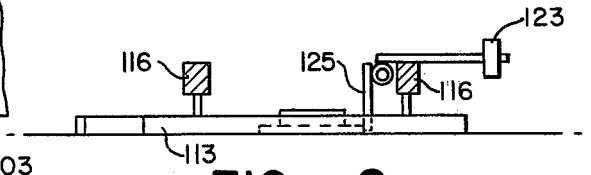
FIG.-8

METHOD AND APPARATUS FOR MAKING POUCHES WITH DISPENSING FITTINGS

This invention relates generally to machines for the manufacture of pouches from a web of plastic film material, and particularly pouches such as are used in the marketing of various liquid materials, and which have at least one annular fitting secured to one wall of the pouch which is used for dispensing the contents.

Certain liquids, such as wine, are presently being marketed in sealed pouches of plastic film material which are disposed within cartons of material such as corrugated fiberboard. An annular fitting that is secured to one wall of the pouch is normally sealed, and when it is desired to dispense the contents, the fitting is coupled to a tap and the seal is broken to permit the liquid to be dispensed. Examples of this type of packaging are disclosed in Curie et al. U.S. Pat. Nos. 3,233,117, Baldwin 2,981,443, Malpas 3,642,172 and McGowen 3,930,286. The fittings used for the purpose may vary in size and shape and generally are made from a suitable molded plastic material. The form of the fitting is customarily annular (e.g., a ring or spigot) with a flange which can be secured to the plastic film, as by heat bonding. The material of the pouch forms a sealing membrane which extends across the opening through the fitting, and which is pierced by the tap when the latter is coupled to the fitting. To facilitate proper introduction of the pouch into the outer carton, it is desirable for the dispensing fitting to be located in a particular position on one wall so that the fitting assumes a proper location relative to one side wall of the carton. This side wall may have a readily removable portion near the lower end of the carton which provides an opening for access to the fitting. In the past it has been customary to secure such fittings to the film material by manual operations. For example, a fitting is manually located on a sheet or web of the plastic film material, and then secured to the film by heat bonding. Heat bonding is carried out by an assembly unit which presses the fitting flange against the underlying film and against a heated annular surface underlying the film. Such manual manufacturing methods are unsatisfactory, particularly because of the cost involved and difficulties in maintaining desired quality standards. In instances where the pouch is filled immediately before or after it is introduced into the outer carton, it is necessary to provide a second fitting which is likewise secured to one wall of the pouch and the film pierced to permit introduction of liquid.

In the manual method of manufacture just described, the filling fitting is likewise manually applied in substantially the same manner.

In general, it is an object of the present invention to provide a machine and method which functions automatically to produce pouches for the type of packaging described above.

Another object of the invention is to provide a machine and method of the above character which deposits one or more fittings on a web of plastic material used in the manufacture of such pouches and which reorients the fittings or fitting on the web, after which the fitting or fittings are automatically secured to the web in the location or locations desired.

Another object is to provide a machine and method which serves automatically to secure one or more fittings to a web of plastic material and which also automatically performs the operations required to incorporate the web into pouches.

A machine in accordance with the present invention comprises means for advancing a web of plastic film material along a predetermined horizontal plane, the advancing movement being intermittent with periods of rest between the periods of movement. The advancing movement is for equal distances corresponding to successive web portions of equal length that are desired for forming the pouches. The advancing movement serves to carry each of the web portions through depositing and fitting or bonding regions. Means in the depositing region serves to deposit a dispensing fitting on each web portion. Also, means is provided in the fitting securing region for bonding the fitting to the web. Preferably, the machine incorporates additional means for forming a pouch incorporating the web portions. It is preferable that the machine is so constructed and operates that the fitting is deposited in advance of the position desired on the web, and that means is provided for orienting the deposited fitting to a desired position on a web portion. The invention also comprises an automated method for forming such pouches, the method making use of the steps of advancing a web of the plastic material along a substantially horizontal plane with the movement being recurrent with periods of rest between periods of advancing movement, the advancing movement being for equal distances corresponding to successive connected web portions of equal length that are desired for forming the pouches. The advancing movement serves to carry each of the web portions through fitting depositing and fitting securing regions. A dispensing fitting is deposited on each web portion in the depositing region, and is secured to the web portion in the fitting securing region during a rest period of the web.

Additional objects and features of the invention will appear from the following description in which an embodiment of the invention is described in detail in conjunction with the accompanying drawing.

FIG. 6 is a side elevational view showing an assembly unit for securing or bonding dispensing fittings to the web.

FIG. 7 is a detail in plan showing gate means for releasably retaining fittings in alignment with the heat assembly.

FIG. 8 is a detail in section showing the gate means of FIG. 7.

FIG. 9 is a view looking toward the right-hand side of FIG. 6.

Figure 1:
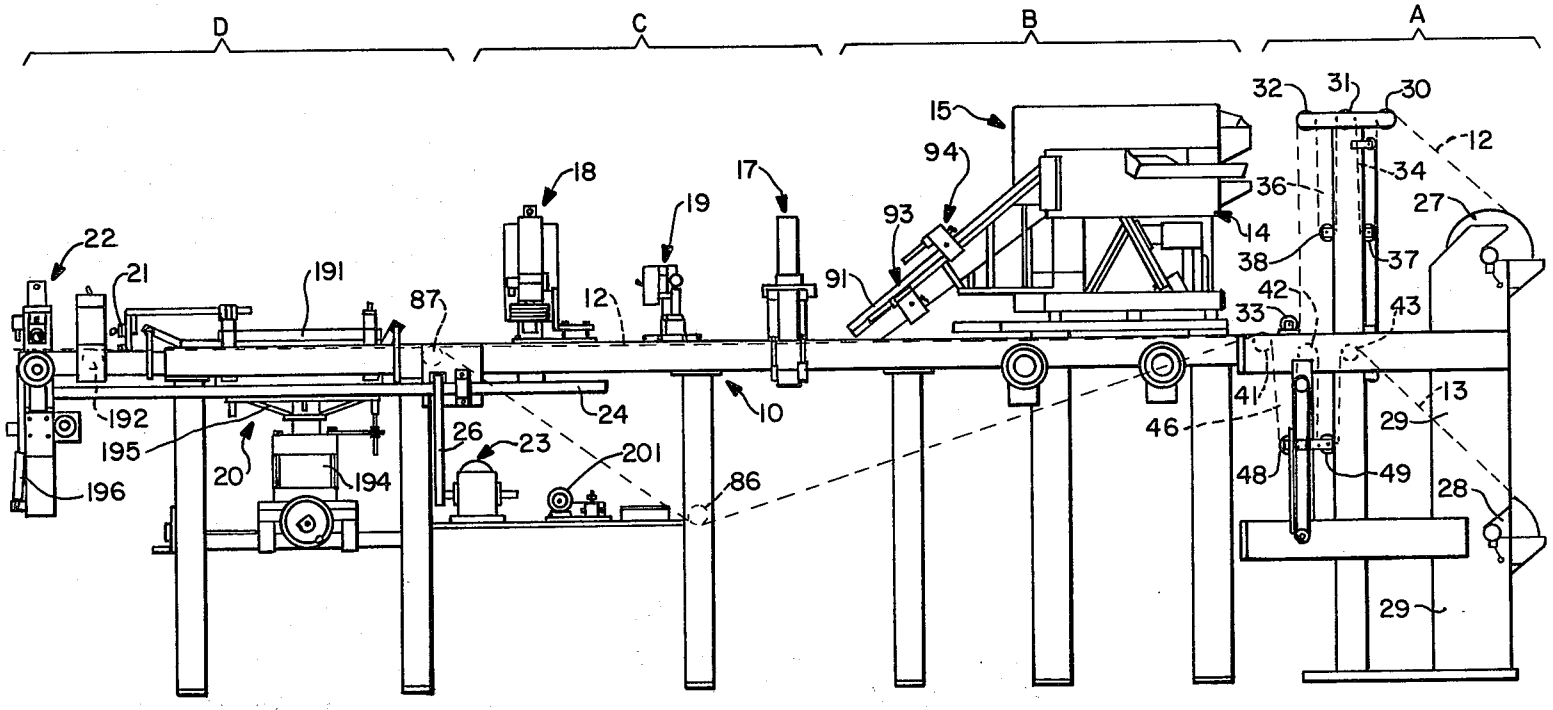
FIG. 1 is a side elevational view illustrating a machine incorporating the invention.
Figure 2:
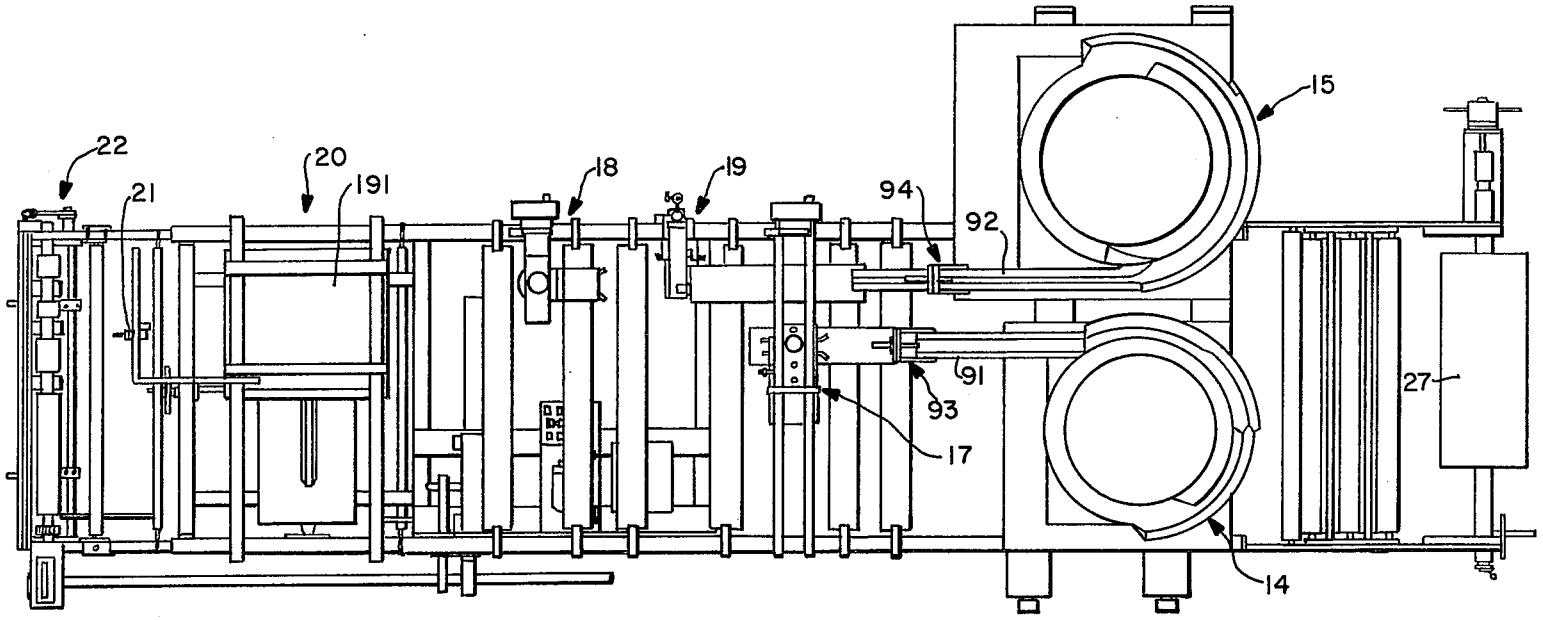
FIG. 2 is a plan view of the machine as shown in FIG. 1.

The machine as shown in FIGS. 1 and 2 consists of a frame 10 which serves to support all of the working parts. Along the length of the frame various regions have been designated by letters A, B, C and D. Region A may be described as a web feeding region or zone and includes means for supporting rolls of plastic film material and for feeding the webs to the machine. Region B is a fitting depositing region and includes means for supplying fittings and depositing them upon the web. Region C is a fitting securing or bonding region and includes means for attaching fittings to the plastic web. Also, means is indicated in region C for piercing the web in locations where it is desired to apply filling fittings.

In region D means is provided for incorporating the web into pouches. Also this region includes means for intermittently drawing the web 12 through the various machine operations. Movement of the web through the regions B, C and D is intermittent, with advancing movement between periods of rest. The advancing movement is by equal distances corresponding to successive connected web portions of equal length that are desired for forming the pouches and the fitting or fittings are secured to these web portions during periods of rest. After leaving region A the web 12 extends in a substantially horizontal plane through the regions B, C and D. It is located at the top of the machine frame 10 and is suitably supported by underlying frame members. A second web 13 is shown extending below the first web. It is joined with the first web in the pouch forming region D.

The various operating units which are mounted upon the frame and which operate upon the web 12 include the units 14 and 15 which serve to feed and deposit dispensing and fitting units upon the upper web. The units 17 and 18 in the region C serve to secure the fittings to the web. The unit 19 serves to pierce the web at certain locations. The pouch forming unit 20 in region D operates upon both webs 12 and 13. The electric eye unit 21 in region D utilizes a photoelectric cell. The draw rolls 22 are actuated to move the webs intermittently and are associated with means for severing the formed pouches. The rolls 22 are driven by the electric motor 23, which is connected to the shaft 24 by belt 26 and which is geared to drive the lower one of the two pull rolls 22. The motor is one of the type which operates at a constant speed when energized, with quick starting, and which stops quickly when deenergized. The circuitry for the motor 23 is controlled by the electric eye unit 21 which senses markings or indicia that are located at regular intervals along the web, the distance between markings corresponding to the length of the web portions which are used in fabricating the pouch.

Figure 3:
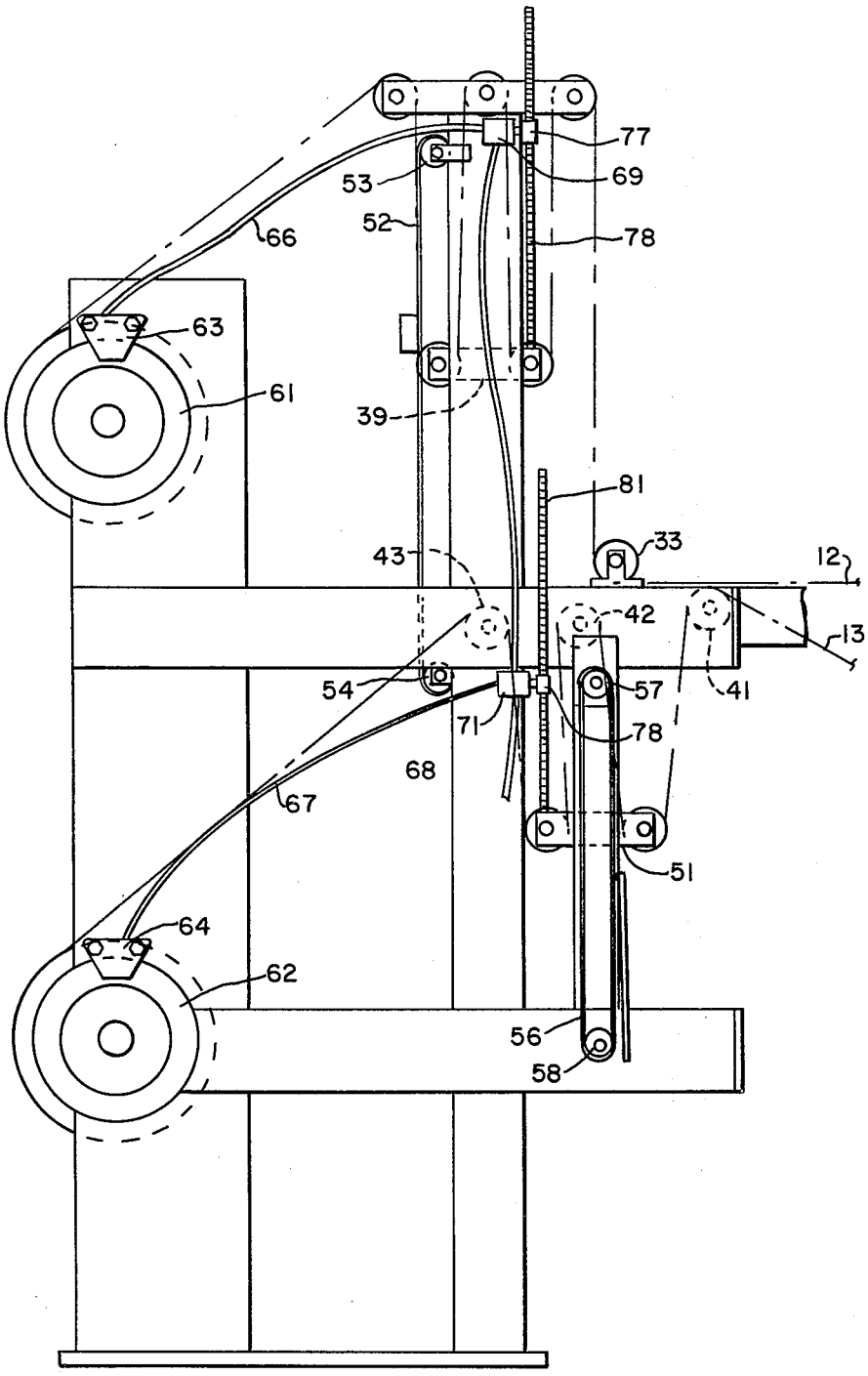
FIG. 3 illustrates the web feeding means, and is a side elevational view on an enlarged scale looking toward one side of the machine at the feed end thereof.

The web supply and feeding means in the web feeding region A may consist of the web supply rolls 27 and 28 rotatably carried by the frame members 29 and which supply the continuous webs 12 and 13. For the purpose of accommodating intermittent feeding of the web without undue stress, jerking or overrunning of the rolls 27 and 28, web 12 is trained over the rolls 30, 31 and 32. From thence it engages the roll 33, and then extends horizontally over the upper part of the frame 10. The web 12 also forms a downwardly extending loop 34 between the rolls 30 and 31, and another downwardly extending loop 36 between the rolls 31 and 32. Tension is applied to these loops by the floating rolls 37 and 38 which are carried by structure 39 (FIGS. 1 and 3). The web 13 is similarly trained over the rolls 41, 42 and 43, between which the downwardly extending loops 44 and 46 are formed which are engaged by the floating rolls 47 and 48. Here again the rolls 47 and 48 are carried by a structure 51.

The loops just described for both the webs 12 and 13 represent a sufficient length of the web whereby for the advancing movements over the frame the loops are shortened to provide the web length desired. During periods of rest the loops are extended to provide material for the next advancing movement.

A counterbalancing means is shown for both the structures 39 and 51 and their associated rollers. Thus a vertically extending endless chain 52 is carried by the upper and lower sprockets 53 and 54. One run of the chain has a connection with the structure 39, and the other run is adapted to have a weight attached to the same. Similar counterbalancing means for the structure 51 and its associated rollers consist of the vertically extending endless chain 56, carried by the upper and lower sprockets 57 and 58. One run of this chain is connected to the structure 51, and the other run is provided with the counterbalancing weight 59.

Preferably, a braking system is also provided to control the length of the web loops. Thus, rotary brake discs 61 and 62 (of FIG. 3) are directly connected to the rotary shafts that carry the rolls 27 and 28, whereby they rotate with rotation of the associated roll. Pneumatically actuated braking shoes 63 and 64 are energized by air pressure applied through the tubes 66 and 67. Air pressure is supplied to these tubes from the tube 68 which connects to a source of air under pressure, and is controlled by the valves 69 and 71. Pinions 77 and 78 secured to the operating stems of these valve devices are engaged by the two racks 79 and 81. These racks are guided by suitable means for vertical movement, and their lower ends are connected to the floating structures 39 and 51. The devices 69 and 71 are so constructed that when a corresponding rack moves upwardly, the pneumatic pressure applied to the corresponding brake shoe 63 is decreased, whereby the braking effort is reduced or eliminated. However, when the rack moves downwardly and the corresponding loops of the web increase in length, the pressure applied to the corresponding brake shoe gradually increases, thus increasing application of braking effort until further extension of the corresponding web loops is arrested. Devices 69 and 71 can be in the form of pressure reducing and back-pressure relief valves, automatically adjusted by rotation of a single operating member. Also, they may be simple throttling valves, together with an orifice for bleeding off air pressure supplied to the braking devices 63 and 64. With the latter arrangement, when a rack moves upwardly, the air supply through the valve 69 or 71 is gradually reduced and simultaneously venting air from the outlet side of the valve (i.e., from the braking shoe or its connected tubing) continuously reduces the braking effort.

The web feeding means described above is adjustable to adapt the machine for pouches of different dimensions. In a addition, the braking means can be adjusted to provide a desired even tensionning of the webs and to provide for the intermittent movement without undue jerking.

With respect to the web 13, it extends from the roll 43 toward the discharge end of the machine and engages the rolls 86 and 87. Beyond the roll 87 it is positioned in juxtaposition with the web 12.

Figure 5:
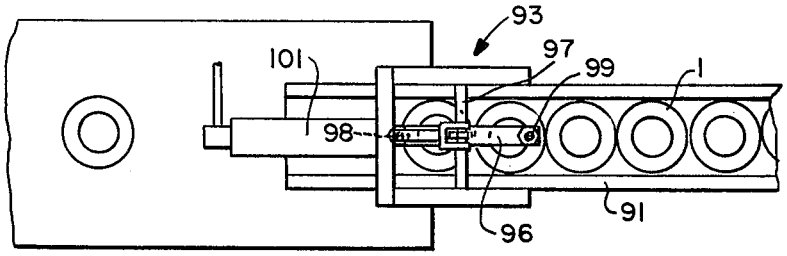
FIG. 5 is a plan view of FIG. 4.
Figure 4:
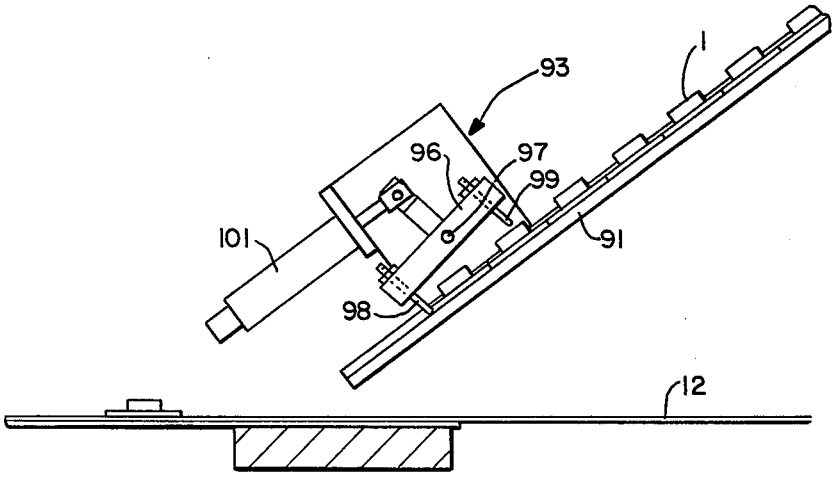
FIG. 4 is a detail, partly in section, illustrating means for controlling the discharge of fittings upon the web.

The feed units 14 and 15 are commercial devices readily available which are capable of orienting the fittings and supplying them single file to the discharge chutes 91 and 92 of FIGS. 2, 4 and 5. From the lower ends of the chutes, the fittings are delivered upon the underlying webs, one at a time, and with that side of the fitting which is to be bonded to the web being faced downwardly. Each chute at its discharge end is provided with means 93 and 94, which serve to retain the first one of the fittings and which when actuated releases the first fitting and permits the file of fittings to move to a position in which the next fitting is in position for release.

FIGS. 4 and 5 illustrate a portion of the chute 92 with its control device 94. The control device consists of the rocker 96 secured to the pivoted shaft 97. The arms of the rocker carry pins 98 and 99, which may be threaded and adjustable. Suitable means, such as a spring, serves to urge the rocker toward the position shown in FIG. 4. The shaft 97 is actuated to flip the rocker 96 between its limiting positions, by the pneumatic actuator 101. This may be of the simple cylinder-piston type. A suitable solenoid valve is employed to control introduction and exhaust of air from the cylinder.

Operation of the device 94 is as follows. The rocker 96 has an amplitude of movement, and the pins 98 and 99 are so adjusted that for one limiting position of the rocker shown in FIG. 4, the lower end of the pin 98 blocks further downward movement of the adjacent fitting. However, when the rocker is actuated to raise the pin 98 and lower the pin 99, the fitting adjacent pin 98 is released, and at the same time, pin 99, which has been moved from a position within the opening of the fitting immediately below the same, blocks further downward movement of the fittings until the rocker is returned to its initial position shown in FIG. 4, with the pin 98 blocking the next fitting. The released fitting is discharged upon the web 12, and thereafter is carried along with the web.

The head assembly 17 shown in FIGS. 6–9 serves to heat-bond the dispensing fittings to the web 12 and it is located in line with the chute 91. It consists of a base member 102 secured by clamping means 103 to the machine frame. A threaded stud 103 carried by member 102 serves to adjustably support an annular member 104, the upper face of which is flat. A suitable annular heating element (not shown) is disposed in the upper face of the member 104, and underlies the adjacent portion of the web 12. A horizontal plate 106 is carried by member 104, and serves to normally effect a separation between member 104 and the web 12. The plate 106 has an opening concentric with and of a diameter somewhat less than the diameter of member 104, but greater than the area of the heating element. A member 107 of the machine frame carries a support member 108 which extends over the member 104. A pneumatic actuator 109, which may be of the cylinder-piston type, is carried by the member 108 in alignment with the member 104.

A tool 111 is attached to the piston rod of the cylinder-piston 109, and is in vertical alignment with the member 104. The lower portion 112 of tool 111 is hollow and in the form of an annulus in cross-section. It is dimensioned to embrace the body of a dispensing fitting and engage the flange of the fitting directly below the same, thereby pressing the fitting flange and the web against the heated member 104 to effect heat bonding of the flange to the web.

Means is associated with the head assembly of FIG. 6 for properly positioning a dispensing fitting below and in alignment with the tool 111. It consists of laterally spaced guide rails 113 which have divergent entrant portions 114. The narrowest part of the guideway between the rails is dimensioned to be slightly greater than the outer diameter of the dispensing fittings. The guide rails are carried by suitable means such as the arms 116 which are adjustably secured to the support member 108 by the bolts 117 and 118. The arrangement is such that the rails 113 have their lower edges in close opposition to the upper surface of the web.

In addition to the guide rails, gate means is provided for retaining a dispensing fitting in alignment below the tool 111 of the head. It consists of a tubular shaft 121 which is rotatably carried by the fixed rod 122 and is biased to rotate in one direction by the counterbalancing weight 123. Counterclockwise rotation of the shaft 121 as viewed in FIG. 8 is limited by the arm 116. A gate 125 is secured to shaft 121, and for the limiting position shown in solid lines in FIG. 8, it extends downwardly with its lower edge in juxtaposition with the web 12. When a dispensing fitting is carried during advancing movement of the web to a position between the guide rails 113 and directly in alignment with the tool 111, the forward edge of the fitting comes to rest by abutment with the gate 125. During continued advancing movement of the web, the fitting is held stationary until forward movement of the web is arrested. Shortly thereafter, as will be presently explained, the cylinder-piston assembly 109 is energized to cause the tool 111 to press downwardly upon the flange of the fitting, thus pressing the flange and the underlying webbed portion against the member 104. After sufficient period of time to effect a heat bond between the flanges of the fitting and web, the tool 111 is retracted. During the next forward movement of the web, the fitting, because it is now bonded to the web, overcomes the bias of the counterweight 123, and thus causes the gate to be swung out of the way to permit the fitting to continue to advance with the web.

The cylinder-piston assembly is energized pneumatically from a source of air under pressure controlled by conventional means, such as pilot valve which in turn is actuated by an electrical solenoid.

Figure 10:
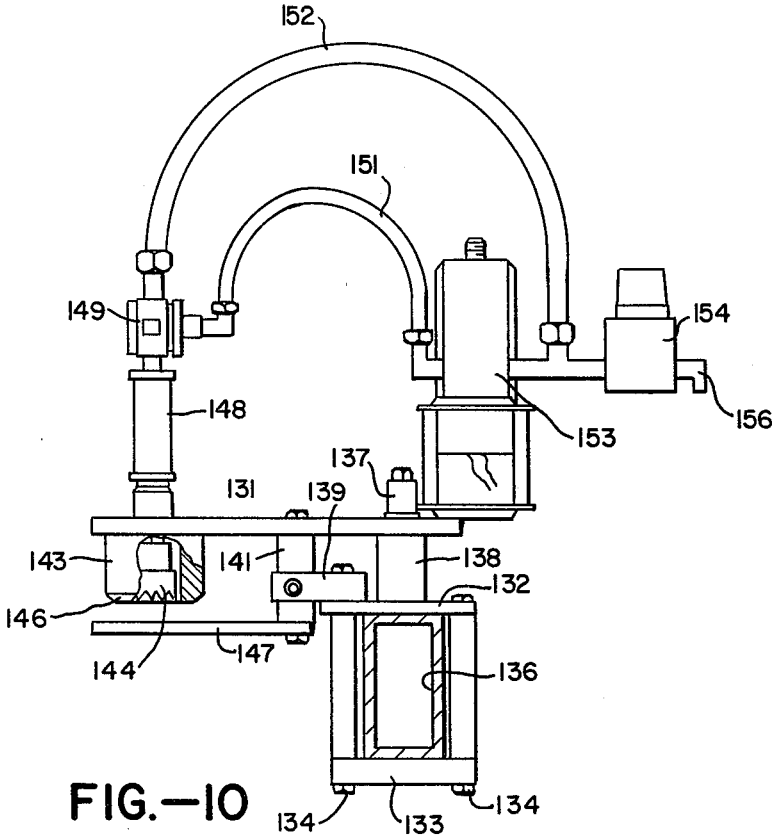
FIG. 10 is a side elevational view illustrating an assembly unit for piercing the web.
Figure 11:
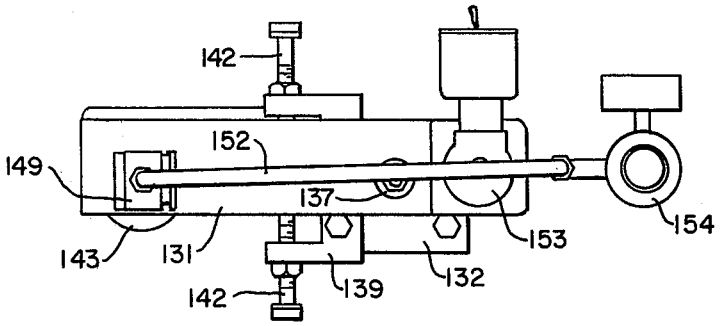
FIG. 11 is a plan view of the assembly unit shown in FIG. 10.

A suitable piercing assembly unit is illustrated in FIGS. 10 and 11. It consists of a support member 131 which is carried by a mounting fixed to the frame of the machine. The mounting in this instance consists of the upper and lower clamping plates 132 and 133 which are clamped by bolts 134 to a member 136 of the machine frame. Member 131 is secured by a pin or bolt 137 to an upstanding member 138 that is mounted upon the upper clamping plate 132.

Also mounted upon the plate 132 there is a C-shaped member 139 which generally embraces a member 141 that is secured to and depends from the member 131. The aligned screws 142 that are threaded in the C-shaped member 139 engage the member 141 and make possible adjustment of the plate 131 in directions toward either end of the machine. This adjustment facilitates accurate location of the holes punched in the successive web portions.

The free end of plate 131 carries an annular shroud or stripper 143 which accommodates a piercing tool 144. The lower end of this tool is hollow and is provided with serrations or teeth 146 to effect the desired punching action when the tool is actuated against the underlying web. Below the shroud 143 there is a die plate 147 which is also secured to the member 141. This plate has an aperture aligned with the tool 143. Normally, the upper web 12 passes between the lower end of shroud 43 and the die-plate 147. Shroud 143 functions as a stripper when the tool 144 is retracted.

The piercing tool 144 may be actuated by the pneumatic cylinder-piston assembly 148. This is likewise energized pneumatically by pneumatic pressure supplied and exhausted by the pilot valve 149 which is shown connected with pneumatic piping 151 and 152. The piping connects the solenoid valve 153 and the pressure reducing valve 154 which in turn is connected to the air supply pipe 156. As will be presently explained, the solenoid valve 153 is energized by a control system which causes the cylinder-piston assembly 148, to be energized to carry out a cycle in which the tool 144 is projected and then retracted to provide a hole in the membrane in the location desired.

Figure 12:
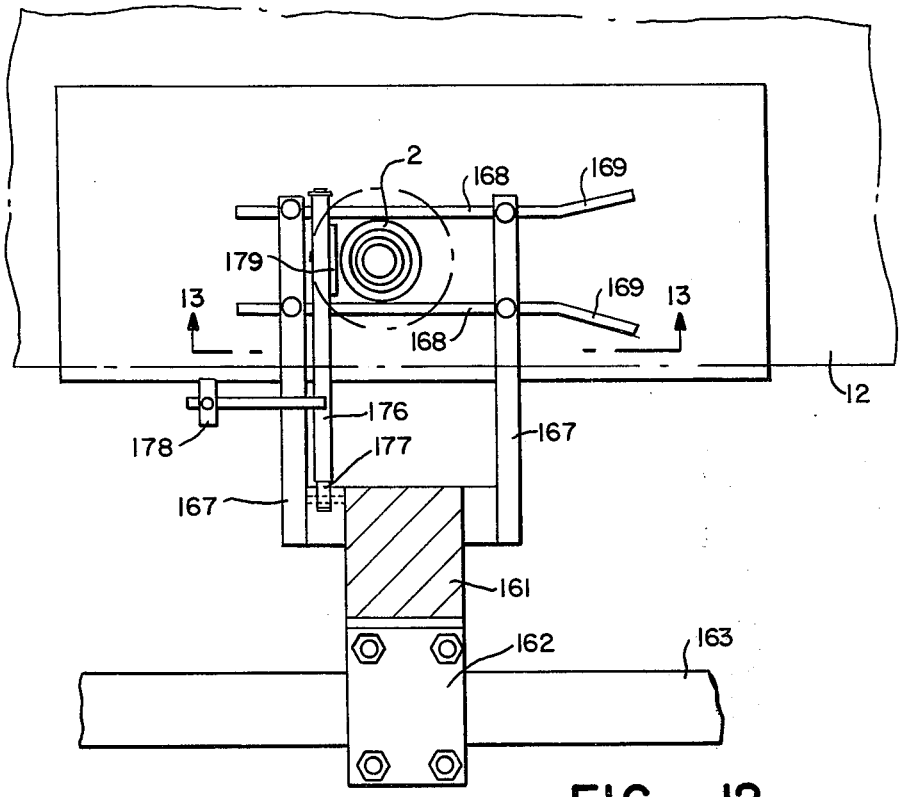
FIG. 12 is a plan view of an assembly unit for heat bonding dispensing fittings to the web.
Figure 13:
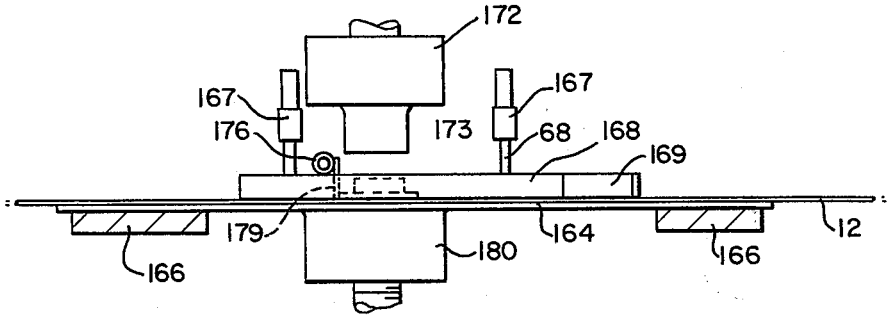
FIG. 13 is a detail in section taken along the line 13—13 of FIG. 12.

FIGS. 12 and 13 show a portion of the unit 18 which serves to secure filling fittings 2 to the web 12. A plate 164 underlies that portion of the web 12 below unit 18, and is supported by members 166 which in turn are secured to the machine frame. Laterally extending arms 167 overlie the web and serve to support the guide rails 168 which have divergent entrance portions 169. The lower edges of these guide rails are in close opposition to the upper surface of the web 12. The spacing between the guide rails is slightly greater than the diameter of the fittings. The mounting 161 also serves to support the cylinder-piston assembly 171 (FIG. 1), and the piston rod of this assembly is directly connected to the tool 172. This tool is similar in construction to the tool 111 of FIG. 6, and its lower portion 173 is a hollow annulus dimensioned to engage the flange of an underlying fitting. The gate means associated with this unit is similar to that illustrated in FIGS. 6, 7 and 8, and consists of a tubular shaft 176 rotatably carried by rod 177, and biased in one direction by the counterweight 178. The gate 179 is secured to the shaft 176, and normally extends downwardly to engage and detain a fitting in alignment with the tool 172. After the fitting has been bonded to the web and the web advances, the gate 179 is swung out of the way to permit the fitting to pass.

The cylinder-piston assembly 171 is likewise operated pneumatically under the control of a pilot valve actuated by solenoid means that is energized by electrical circuitry. The fixed member 180, carried by plate 164, is provided with an electrically heated annular area, like member 104 of FIG. 6.

Figure 14:
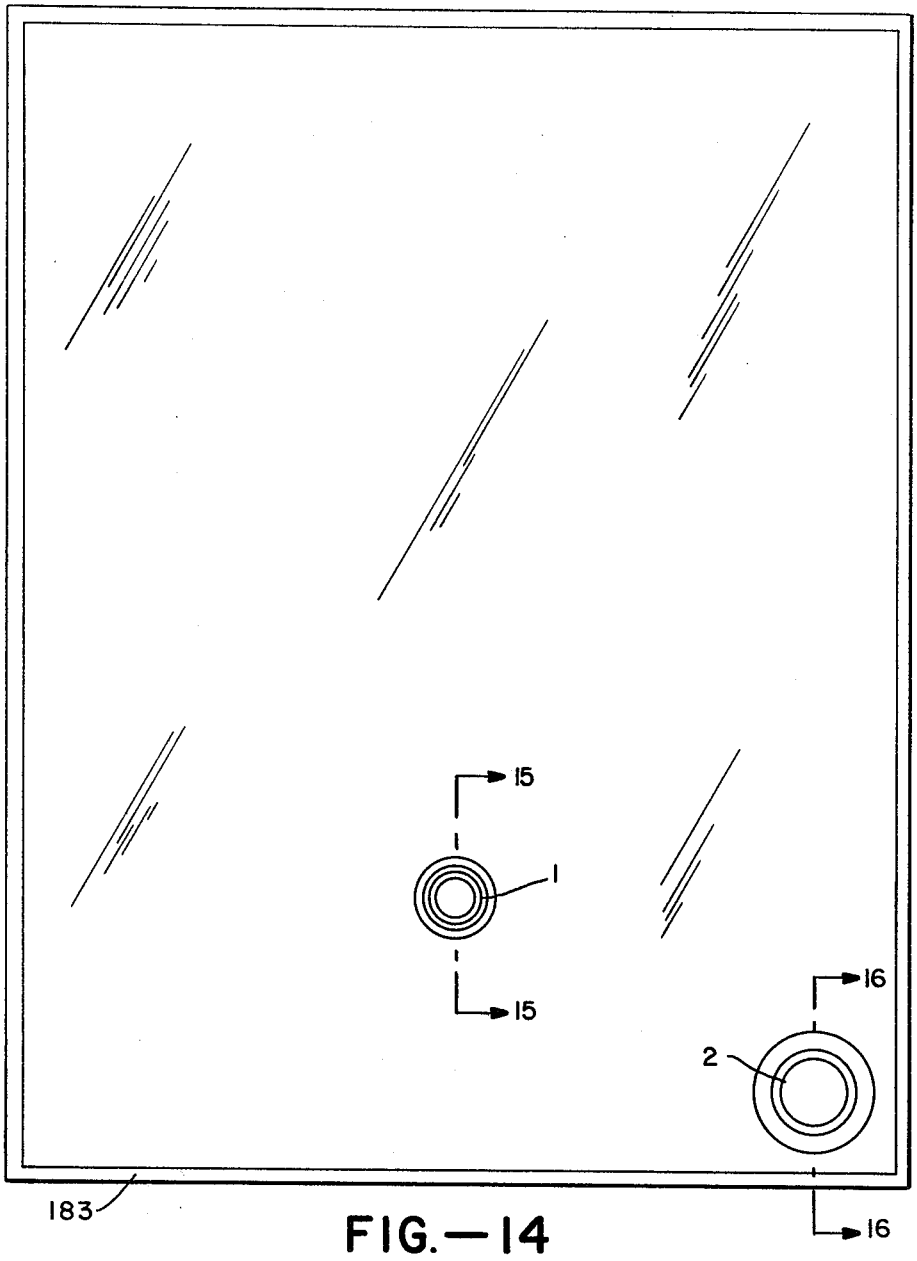
FIG. 14 is a plan view of a typical pouch made in accordance with the present invention.

The pouch forming means within the region D (FIGS. 1 and 17) may be of conventional construction, capable of producing a heat-sealed pouch of the type illustrated in FIG. 14. In this instance, the filling and the dispensing fittings 2 and 1 are shown secured to one side-wall of the pouch, and the two side-walls of the pouch comprise web portions of the upper and lower webs 12 and 13. In region D the two web portions are heat bonded together along the peripheral margin 183.

Figure 15:
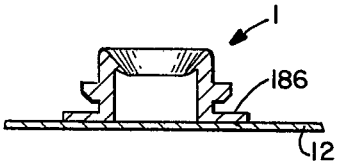
FIG. 15 is a cross-sectional detail on an enlarged scale, taken along the line 15—15 of FIG. 14.
Figure 16:
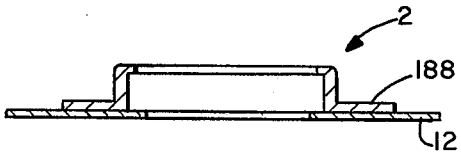
FIG. 16 is a cross-sectional detail on an enlarged scale, taken along the line 16—16 of FIG. 14.

FIG. 15 illustrates a dispensing fitting 1 which is made of suitable plastic material, and which has a flange 186 that has been heat bonded to the web 12. The type of fitting here shown is disclosed in my copending application Ser. No. 116,475, filed Jan. 29, 1980. FIG. 16 shows a filling fitting 2 which likewise is provided with a flange 199 that is heat bonded to the web 12. In this instance, the web has an opening 189 which is produced by the piercing unit 19.

Figure 17:
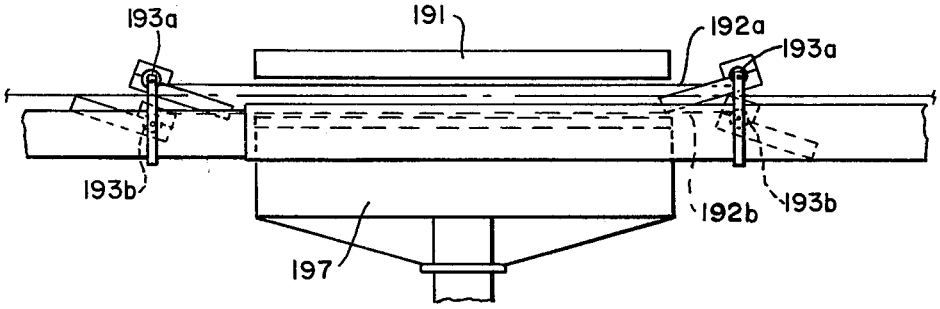
FIG. 17 is a schematic view illustrating means for heat sealing the pouches.

As shown in FIGS. 1, 2 and 17, the pouch forming means can consist of a horizontal plate 191 that is secured to the machine frame, and which overlies superimposed portions of the webs 12 and 13 that are disposed directly beneath the same. As shown schematically in FIG. 17, sheets **192*a* and 192*b*, made of suitable fabric reinforced material that is not affected by the temperature used for heat sealing, are disposed below plate 191 and are carried and maintained tensioned by two pairs of spring biased rolls 193*a* and 193*b*. The webs 12 and 13 pass between the sheets 192*a* and 192*b*. A pneumatic actuator 194 of the cylinder-piston type has its piston rod secured to the pressing head 197**, and the upper face of the head has an electrically heated area corresponding to the dimensions of the pouch margin which is to be heat sealed. Pneumatic energizing of the cylinder-piston assembly is controlled by the electrical system to be presently described.

Figure 18:
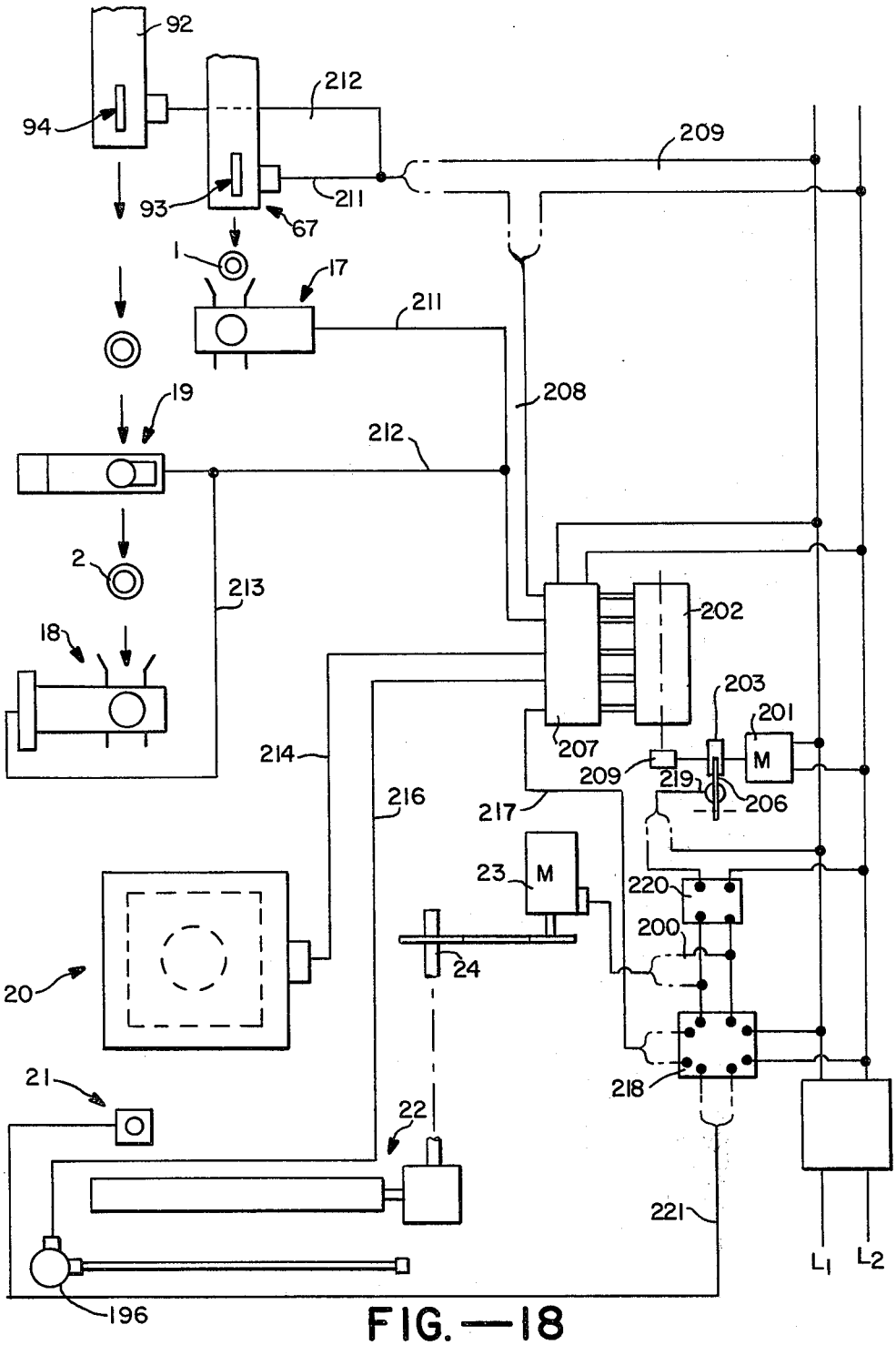
FIG. 18 is a schematic diagram illustrating means for controlling the various operations of the machine.

The pull rolls 22 are driven in the manner previously described, and may likewise be of conventional construction, designed to advance the two webs after portions have been joined together by heat sealing. The cutting means immediately following the rolls 22 may likewise be conventional, consisting for example of a stationary blade, and a moveable blade which is moved between cutting and retracted positions by the pneumatic operator 196. This operator likewise is controlled by the electrical system to be presently described. FIG. 18 schematically illustrates a suitable electrical system for actuating and controlling the various functions of the machine. As previously explained, the electric eye 21 is responsive to markings on the upper web 12 and the marks are spaced apart a distance depending upon the length of the pouches being manufactured. The electric eye 21 controls the supply current to the motor 23 which drives the rolls 22. Power to the motor circuit 200 and to the other devices controlled by the system is supplied from the current supply lines L-1 and L-2. The arrangement is such that when a mark on the upper web is detected by the electric eye, the motor 23 stops and remains de-energized for a given timed period during which the web is at rest. After that period, the motor is automatically energized to drive the rolls 22 for advancing the web until the next mark is detected by the electric eye.

In conjunction with motor 23 there is another continuously energized motor 201 which serves to drive the multiple cam programming assembly 202. The drive is through a cycling clutch 203 and gearing 204. The latch member 206 for starting and stopping the drive through the cycling clutch is controlled by programming assembly 207 to be later described. The arrangement is such that when motor 23 is operating, the drive through the clutch 203 is interrupted and the multiple cam assembly 207 is stationary. However, when power to motor 23 is interrupted, the latch 206 is caused to release the cycling clutch whereby the clutch makes one revolution and the cam assembly is caused to rotate one revolution. The cam assembly includes cam members which operate switches within the switch assembly 207, each cam of the assembly being contoured to provide the required periods of operation to its corresponding switch. One switch of the assembly 207 is shown connected by cable 208 with a circuit 209 which is connected by cables 211 and 212 to energize the devices 67 of the chutes 56 and 57. A second switch is connected to cables 211, 212, and 213 to simultaneously energize the head assemblies 17 and 18 and the piercing head 19. The third switch is shown connected by cable 214 to the press 20 for forming the pouches. The fourth switch is shown connected by cable 216 to the operating means 196 for the cutting assembly. The fifth switch is shown connected by cable 217 to the motor control box 218 for motor 23. Cable 219 connects the electrical operator of latch 206 with relay switch 220, which connects across the leads to motor 23. The electric eye is connected by cable 221 with control box 218 and this box is included in the motor circuit 200. When the eye detects a web marking, control box 218 interrupts the motor circuit. When this occurs, the response of relay 220 applies a current pulse to the electrical operator of latch 206 whereby the latch is tripped to cause cam assembly to be driven one revolution. At the end of this cycle the fifth switch, through cable 217, causes control box 218 to again close the circuit to motor 23.

Overall operation of the machine and the method are as follows. The speed of operation of motor 23, and the time period during which it is stationary, are adjusted as desired. Such adjustments determine the rate at which complete pouches are made. When motor 23 is being energized, the webs advance step by step with interposed stop periods when the webs are stationary. The fittings are supplied single file down the inclined chutes 91 and 92 and are released by devices 94 as determined by the cam assembly 202. Release occurs during a stop period of the web 12. During the next advancing movement of the web both fittings travel with the web. Before this movement is completed, the filling fitting is guided laterally and then its forward movements arrested as it reaches a position of alignment with the assembly unit 17. During the following stop period unit 17 is energized to carry out a bonding or sealing operation in which the flange of the fitting is heat bonded to the web 12. At the same time the piercing unit 19 is energized to punch a hole in the web in a location where the filling fitting is to be applied. During the next advancing movement the filling fitting that was deposited in the preceding operating cycle and which is in advance of the punched hole is guided laterally into alignment with unit 18 and its forward movement is arrested. During this remaining forward movement of the web, the punched hole is brought to a position where it is in registration with the fitting. During the next stop period unit 18 is energized to heat bond the flange of the fitting to the web. The web now has two bonded on fittings. During a subsequent forward movement the web is brought into the pouch forming region where it is superimposed over a position of the web 13. During the next stop period the press 197 is operated to carry out the heat sealing operation to form a pouch. The webs then progress through the roll assembly 22, and in a subsequent stop period the formed pouch is severed from a following pouch.

While the above described machine and method forms the pouches from the superposed webs, the web 12 after application of the fittings may be made into pouches without using a second web. For example after application of the fittings the web may be supplied to known types of pouch or bag forming machines which develop the web into a tube with a longitudinal seal between overlapping edges, and which effect transverse sealing at spaced distances, followed by cutting to separate the resulting bags or pouches. Also when such pouch forming machines are employed, the pouches may be filled with liquid (e.g., wine), as the tube is being formed, but before the upper transverse seal of a pouch portion is applied. In such event, the filling fitting and the film punching means are omitted.

What is claimed is:

1. In an automated method of forming a pouch of film material with one wall portion of the pouch having an annular fitting secured to the same, the steps of advancing a web of the film material along a substantially horizontal plane, the movement being recurrent with periods of rest between periods of advancing movement, the advancing movement being for equal distances corresponding to successive connected web portions of equal length that are desired for forming the pouches, the advancing movement serving to carry each of such web portions through depositing and fitting securing regions, depositing a dispensing fitting on each web portion in the depositing region, orienting each fitting to the position on the web where it is desired to secure the same, such orienting being carried out by shifting the fitting laterally of the direction of web movement during advancing movement of the web to align the same with the fitting securing region, such lateral shifting being carried out by contacting the fitting with stationary guide rails during such advancing movement, and by arresting the fitting in said region by engaging the fitting with a removable stationary barrier, securing each such fitting to a web portion in the fitting securing region during a rest period and while the fitting is being retained in alignment with the fitting securing region, and then moving the barrier to an out-of-the-way position and advancing the web with the secured fitting.

2. In an automated method as in claim 1, in which the advancing movement of the web after the fitting is secured thereto, serves to apply force to the barrier to move the same to said out-of-the-way position.

3. A method as in claim 2 in which each web portion, before attaching the fitting to the same, is pierced in the location where a fitting is subsequently attached, thereby providing a filling opening through the web and within a fitting.

4. A machine for the manufacture of pouches of plastic film material with one wall portion of the pouch having an annular fitting secured to the same, means for advancing a web of plastic film material along a substantially horizontal plane, the advancing movement being intermittent with periods of rest between the periods of advancing movement, the advancing movements being for equal distances corresponding to successive connected web portions of equal length that are desired for forming the pouches, the advancing movement serving to carry each of such web portions through depositing and fitting securing regions, means in the depositing region for depositing a fitting on each portion of the web, means in the fitting securing region for securing the fitting to the web during a period of rest, and means for guiding the fitting into alignment with the securing means during advancing movement of the web and for restraining the fitting in said region during operation of the fitting securing means, said last means comprising stationary converging guide rails between which each fitting is advanced to the securing region and a separate removable barrier for arresting such advancing movement when the fitting has been advanced to the securing region.

5. A machine as in claim 4 together with means for forming pouches incorporating the web portions, each of said pouches having a fitting secured to one wall of the same.

6. A machine for forming pouches of plastic film material with one wall portion of each pouch having an annular fitting secured to the same, means for intermittently advancing a web of plastic material along a substantially horizontal plane, the movement being recurrent with periods of rest between periods of advancing movement and the advancing movement being for equal distances corresponding to successive web portions of equal length that are desired for forming the pouches, the advancing movement serving to carry each web portion through depositing and fitting securing regions, means for feeding and depositing an annular fitting on the web in the depositing region, the position where a fitting is deposited being in advance of the position desired, means for orienting each deposited fitting to a desired position on a web portion, said orienting means including convergent stationary guide members serving to guide the fitting into said fitting securing region and separate removable barrier means for restraining the fitting in the securing region, and means in the securing region for securing the deposited fitting to the associated web portion.

7. A machine as in claim 6 in which said separate barrier means is a pivotally suspended gate that is swung to an out-of-the-way position by force applied to the same when the web portion is advanced after the fitting has been secured to the same.

8. A machine as in claim 6 together with means adapted to be actuated to effect piercing of each web portion in a desired location, the orienting means serving to orient the fitting to said position.

* * * * *